US009966672B2

(12) United States Patent
Aoki

(10) Patent No.: US 9,966,672 B2
(45) Date of Patent: May 8, 2018

(54) CONNECTING STRUCTURE OF CRIMP TERMINAL AND ELECTRIC WIRE

(71) Applicant: YAZAKI CORPORATION, Tokyo (JP)

(72) Inventor: Hiroshi Aoki, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days. days.

(21) Appl. No.: 15/247,985

(22) Filed: Aug. 26, 2016

(65) Prior Publication Data

US 2016/0365648 A1 Dec. 15, 2016

Related U.S. Application Data

(63) Continuation of application No. PCT/JP2015/058765, filed on Mar. 23, 2015.

(30) Foreign Application Priority Data

Mar. 28, 2014 (JP) ..... 2014-068070

(51) Int. Cl.
*H01R 4/10* (2006.01)
*H01R 4/18* (2006.01)
(Continued)

(52) U.S. Cl.
CPC ..... *H01R 4/185* (2013.01); *H01B 1/026* (2013.01); *H01R 4/62* (2013.01); *H01R 13/03* (2013.01); *H01R 43/048* (2013.01)

(58) Field of Classification Search
CPC .... H01R 43/16; H01R 13/113; H01R 43/048; H01R 13/03; H01R 4/62; H01R 4/185; H01B 1/026
(Continued)

(56) References Cited

U.S. PATENT DOCUMENTS 3,823,392 A * 7/1974 Pfeifer ..... H01R 13/112 439/856
5,658,174 A * 8/1997 Benes ..... H01R 13/187 439/842
(Continued)

FOREIGN PATENT DOCUMENTS

CN 1172357 A 2/1998
CN 1192064 A 9/1998
(Continued)

OTHER PUBLICATIONS

International Search Report for PCT/JP2015/058765 dated Apr. 21, 2015.
(Continued)

*Primary Examiner* — Abdullah Riyami
*Assistant Examiner* — Nelson R Burgos-Guntin
(74) *Attorney, Agent, or Firm* — Sughrue Mion, PLLC

(57) ABSTRACT

A connecting structure of a crimp terminal and an electric wire includes an electric wire including a conductor, an insulating coating covering the conductor, and a conductor exposed part where the conductor is exposed by removing the coating on an end part of the electric wire; a crimp terminal made of a metal material different from that of the conductor and includes an electric wire connector including a conductor crimping portion that crimps the conductor exposed part of the end part of the electric wire and a coating crimping portion that crimps a part of the coating left in the end part of the electric wire; and an intermediate potential film deposited by spraying a metal having a potential different from that of the metal material of the crimp terminal on an outer periphery of the electric wire connector being crimped to the end part of the electric wire.

8 Claims, 4 Drawing Sheets

(51) Int. Cl.

| | |
|---|---|
| ***H01R 4/62*** | (2006.01) |
| ***H01B 1/02*** | (2006.01) |
| *H01R 13/03* | (2006.01) |
| *H01R 43/048* | (2006.01) |

(58) Field of Classification Search
USPC ..... 439/867, 866, 885, 246, 252, 842, 852, 439/850, 877, 862
See application file for complete search history.

(56) References Cited

U.S. PATENT DOCUMENTS

| | | | | |
|---|---|---|---|---|
| 5,964,612 | A | 10/1999 | Hatagishi | |
| 5,967,860 | A * | 10/1999 | Ricketts | B32B 15/01 420/501 |
| 6,186,810 | B1 * | 2/2001 | Barnabe | H01R 13/187 439/252 |
| 6,299,489 | B1 * | 10/2001 | Phillips | H01R 13/111 439/252 |
| 6,315,591 | B2 * | 11/2001 | Oda | H01R 13/18 439/246 |
| 6,338,638 | B2 * | 1/2002 | Kodama | H01R 13/11 439/246 |
| 6,439,935 | B2 * | 8/2002 | Saka | H01R 13/113 439/842 |
| 6,447,345 | B2 * | 9/2002 | Sato | H01R 43/16 439/842 |
| 6,585,544 | B2 * | 7/2003 | Furutani | H01R 13/113 439/252 |
| 6,736,684 | B2 * | 5/2004 | Ishiyama | H01R 13/187 439/852 |
| 6,755,697 | B2 * | 6/2004 | Kojima | H01R 13/114 439/595 |
| 7,300,319 | B2 * | 11/2007 | Lutsch | H01R 4/185 439/845 |
| 7,905,755 | B1 * | 3/2011 | Martauz | H01R 4/184 205/118 |
| 9,011,186 | B2 * | 4/2015 | Wirth | H01R 13/112 439/843 |
| 2006/0035538 | A1 * | 2/2006 | Suemitsu | H01R 13/113 439/852 |
| 2010/0120302 | A1 | 5/2010 | Kumakura | |
| 2011/0086557 | A1 * | 4/2011 | Kubota | H01R 13/113 439/842 |
| 2011/0225820 | A1 | 9/2011 | Kondo et al. | |
| 2012/0142233 | A1 * | 6/2012 | Blasko | H01R 13/113 439/852 |
| 2012/0329341 | A1 * | 12/2012 | Morikawa | H01R 4/185 439/866 |
| 2012/0329343 | A1 | 12/2012 | Sato et al. | |
| 2013/0273787 | A1 * | 10/2013 | Mitose | H01R 4/185 439/878 |
| 2013/0288546 | A1 * | 10/2013 | Okano | H01R 13/11 439/852 |
| 2014/0302729 | A1 | 10/2014 | Kodama et al. | |
| 2015/0050838 | A1 * | 2/2015 | Copper | H01R 13/114 439/626 |
| 2015/0188244 | A1 * | 7/2015 | Yoshioka | H01M 2/20 439/442 |
| 2015/0222038 | A1 * | 8/2015 | Volpone | H01R 13/113 439/842 |
| 2015/0318654 | A1 * | 11/2015 | Kawamura | H01R 43/048 439/877 |
| 2015/0340773 | A1 | 11/2015 | Sato | |
| 2016/0126642 | A1 * | 5/2016 | Tonoike | H01R 4/183 439/877 |
| 2016/0359251 | A1 * | 12/2016 | Droesbeke | H01R 13/113 |

FOREIGN PATENT DOCUMENTS

| | | | |
|---|---|---|---|
| CN | 101740880 | A | 6/2010 |
| CN | 101904061 | A | 12/2010 |
| CN | 102511111 | A | 6/2012 |
| CN | 102782942 | A | 11/2012 |
| JP | 2011-165618 | A | 8/2011 |
| JP | 2013-134891 | A | 7/2013 |

OTHER PUBLICATIONS

Communication dated Jan. 9, 2018 from the Japanese Patent Office in counterpart Application No. 2014-068070.
Communication dated Dec. 1, 2017 issued by the State Intellectual Property Office of the People's Republic of China in counterpart Application No. 201580010912.X.

* cited by examiner

CONNECTING STRUCTURE OF CRIMP TERMINAL AND ELECTRIC WIRE

CROSS-REFERENCE TO RELATED APPLICATION(S)

This application is a continuation application of International Application PCT/JP2015/058765, filed on Mar. 23, 2015, and designating the U.S., the entire contents of which are incorporated herein by reference.

BACKGROUND OF THE INVENTION

1. Field of the Invention

The present invention relates to a connecting structure of a crimp terminal and an electric wire.

2. Description of the Related Art

Reduction in the weight of a vehicle has a great influence on improvement of fuel consumption. Currently, reduction in carbon dioxide emission is required, and especially in an electric vehicle and a hybrid vehicle where the amount of wire harnesses used therein is larger than that in a gasoline-powered vehicle, it is preferable that an electric wire made of aluminum and an aluminum alloy of lightweight materials be used for a wire harness. However, in an aluminum-made electric wire made of aluminum or an aluminum alloy being crimped and connected to a crimp terminal made of copper or a copper alloy, when water is in a part where the electric wire and the crimp terminal contact each other, this water serves as an electrolyte between dissimilar metals. In dissimilar metals such as a copper-made terminal and an aluminum-made conductor, when an electric circuit is formed through an electrolyte, corrosion of a metal having a baser potential (for example, the aluminum conductor) is accelerated due to difference in corrosion potential of the dissimilar metals. In other words, galvanic corrosion occurs.

For example, there is an electric wire with a terminal that Japanese Patent Application Laid-open No. 2011-165618 discloses in order to prevent galvanic corrosion that occurs when a crimp terminal and a conductor made of such dissimilar metal materials are connected to each other. As illustrated in FIG. 5, this electric wire with a terminal 501 includes a terminal 503 and an electric wire 509 in which an insulating layer 507 is formed on a conductor 505 made of a metal material different from that of the terminal 503. The electric wire with a terminal 501 in which the terminal 503 is connected to the conductor 505 has a conductive anticorrosion layer 511 made of titanium (Ti) or a Ti alloy formed on a surface of the terminal 503 to which the conductor 505 is connected. The conductive anticorrosion layer 511 can be obtained by a composite material (clad material) that integrates a copper (Cu) strip (thickness 2.0 mm) with a nickel (Ni) strip (thickness 0.25 mm) using a method for cold rolling or a composite material that masks one surface of a Cu strip (thickness 0.8 mm) and applies Ni plating (thickness 10 μm) to only one surface.

In this manner, the electric wire with a terminal 501 has the conductive anticorrosion layer 511 made of any one of Ni, an Ni alloy, Ti and a Ti alloy formed on a surface of a second connecting portion 513 that is connected to the conductor 505 of the electric wire 509. Resultingly, galvanic corrosion that occurs when the terminal 503 and the conductor 505 made of dissimilar metal materials are connected to each other is prevented.

However, use of an expensive clad material causes an increase in cost of the terminal 503. When the terminal 503 includes a first connecting portion 515 to a counterpart terminal, generally, if tin (Sn) plating applied to the first connecting portion 515 differs from plating (such as Ti) applied to the conductive anticorrosion layer 511, two kinds of plating processing are required. Applying two kinds of plating processing to one terminal 503 requires masking, and a plating processing process is complicated. In this case, manufacturing cost is increased as compared with the case of one kind of plated terminal. In addition, when plating used for the conductive anticorrosion layer 511 alone is applied to the whole terminal, a fitting counterpart requires a change of plating as well, and an existing product becomes unavailable.

SUMMARY OF THE INVENTION

The present invention has been made in view of the above circumstances, and an object thereof is to provide a connecting structure of a crimp terminal and an electric wire capable of delaying corrosion of a conductor when a crimp terminal and the conductor made of dissimilar metal materials are connected to each other without applying complicated plating processing, and also preventing corrosion due to intrusion of water.

In order to achieve the above mentioned object, a connecting structure of a crimp terminal and an electric wire according to one aspect of the present invention includes an electric wire that includes a conductor, an insulating coating covering the conductor, and a conductor exposed part where the conductor is exposed by removing the coating on an end part of the electric wire; a crimp terminal that is made of a metal material different from that of the conductor and includes an electric wire connector, the electric wire connector including a conductor crimping portion being configured to crimp the conductor exposed part of the end part of the electric wire and a coating crimping portion being configured to crimp a part of the coating left in the end part of the electric wire; and an intermediate potential film that is deposited by spraying a metal having a potential different from a potential of the metal material of the crimp terminal on an outer periphery of the electric wire connector that is being crimped to the end part of the electric wire.

According to another aspect of the present invention, in the connecting structure of the crimp terminal and the electric wire, it is desirable that the conductor is made of aluminum or an aluminum alloy, and the crimp terminal is made of copper or a copper alloy.

According to still another aspect of the present invention, in the connecting structure of the crimp terminal and the electric wire, it is desirable that the intermediate potential film is made of zinc.

According to still another aspect of the present invention, in the connecting structure of the crimp terminal and the electric wire, it is desirable that, in the crimp terminal, the electric wire connector is formed to have a U-shaped cross section continuously extending from a front end of the conductor crimping portion to a rear end of the coating crimping portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

An embodiment of a connecting structure of a crimp terminal and an electric wire according to the present invention will now be described with reference the accompanying drawings.

Figure 1:
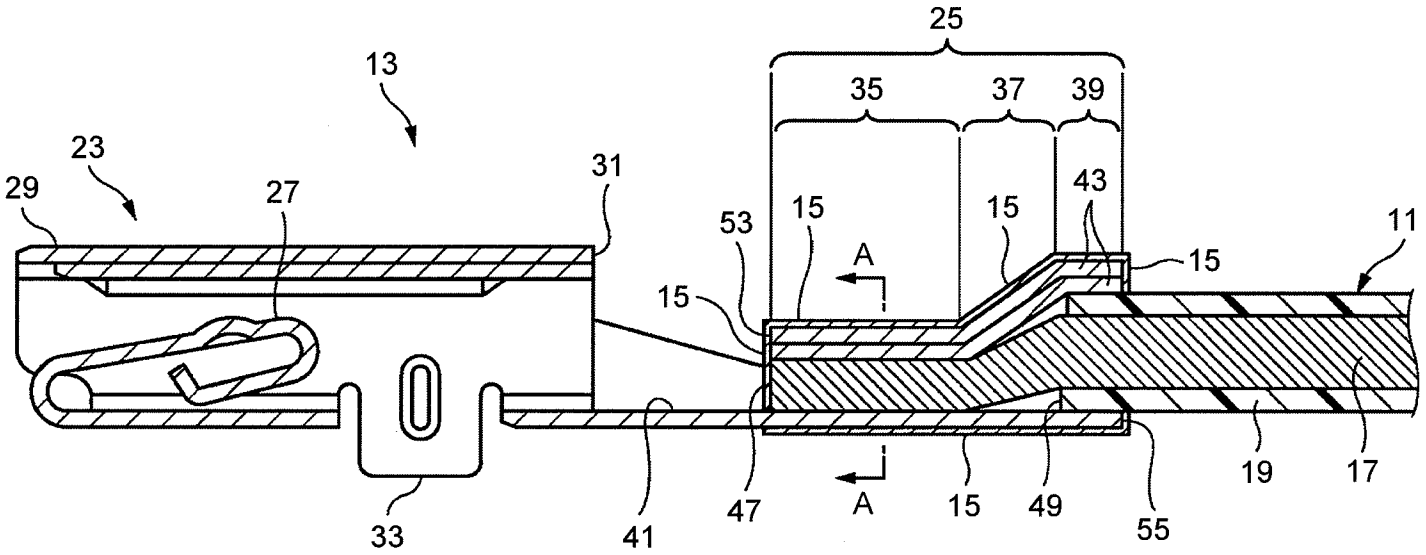
FIG. 1 is a longitudinal cross-sectional view illustrating a connecting structure of a crimp terminal and an electric wire in accordance with an embodiment of the present invention.

As illustrated in FIG. 1, the connecting structure of a crimp terminal and an electric wire according to one embodiment of the present invention includes an electric wire 11, a crimp terminal 13, and an intermediate potential film 15.

The electric wire 11 includes a conductor 17 covered with an insulating coating 19. The conductor 17 is formed by twisting together a plurality of element wires. The conductor 17 may be a single wire. For example, aluminum and an aluminum alloy are used for the conductor 17. A synthetic resin is used for the coating 19. Examples of the synthetic resin include a resin formed by adding a flame retardant to a base such as polyvinyl chloride (PVC), polyolefin, and polyamide.

Figure 2:
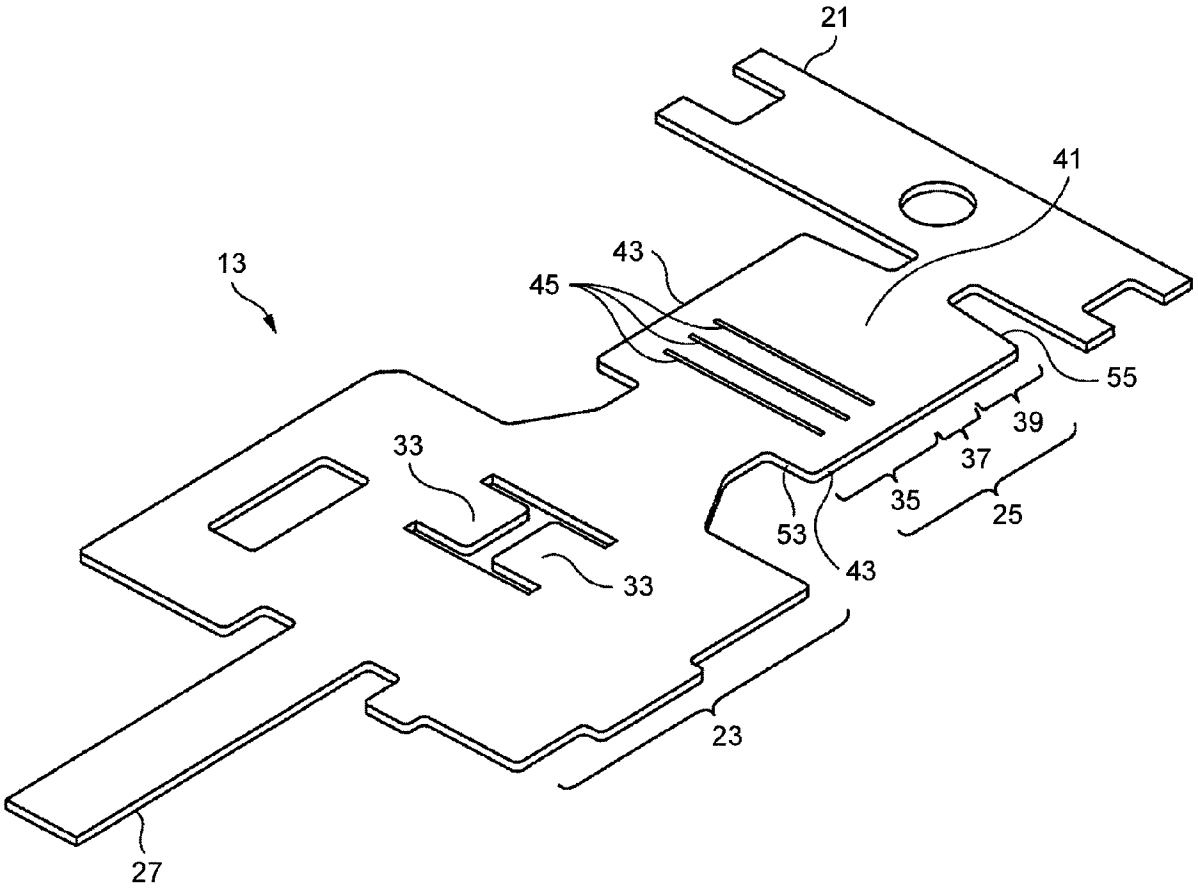
FIG. 2 is a development view illustrating the crimp terminal illustrated in FIG. 1.

The crimp terminal 13 is formed by applying press working (punch working and folding working) to a sheet of metal plate made of a conductive metal (copper and a copper alloy) (FIG. 2). The crimp terminal 13 is punched while being connected to a carrier 21 into a chain shape. The crimp terminal 13 is installed on, for example, a connector housing (not illustrated) so as to be used. The crimp terminal 13 includes an electric contact portion 23 and an electric wire connector 25 serially from the tip end side (in other words, a counterpart terminal side). The electric contact portion 23 electrically contacts a counterpart terminal. The electric wire connector 25 is connected to the electric wire 11. A box section 29 including a spring part 27 is formed on the electric contact portion 23. The box section 29 receives a tab-shaped conductor connecting portion of a male terminal (not illustrated) serving as a counterpart terminal, and conductively connects the spring part 27 to the male terminal. In other words, the crimp terminal 13 is a female terminal.

A lance locking portion 31 is formed on the box section 29. When the crimp terminal 13 enters a terminal housing chamber of the connector housing, the lance locking portion 31 is locked to a lance (not illustrated) formed on the rear side of the connector housing. In this manner, the crimp terminal 13 is controlled not to slip backward off from the terminal housing chamber. The box section 29 includes a spacer contact portion 33. When a spacer (not illustrated) is attached to the connector housing, a secondary locking portion formed on the spacer contacts the spacer contact portion 33.

As illustrated in FIG. 2, the electric wire connector 25 includes a conductor crimping portion 35 crimped to a conductor exposed part of the electric wire 11 at a position on the front side (that is a counterpart terminal side and an electric contact portion 23 side). The conductor exposed part is a part where the conductor 17 is exposed by removing the coating 19 on an end part of the electric wire 11. The electric wire connector 25 includes a coating crimping portion 39 with a joint 37 at a position on the rear side of the conductor crimping portion 35. The coating crimping portion 39 is a part that is crimped to the coating 19 of the end part of the electric wire 11. The joint 37 joins the rear side of the conductor crimping portion 35 and the front side of the coating crimping portion 39. The conductor crimping portion 35 and the coating crimping portion 39 are formed to have the size corresponding to a diameter of the conductor 17 and a diameter of the coating 19.

Figure 3A:
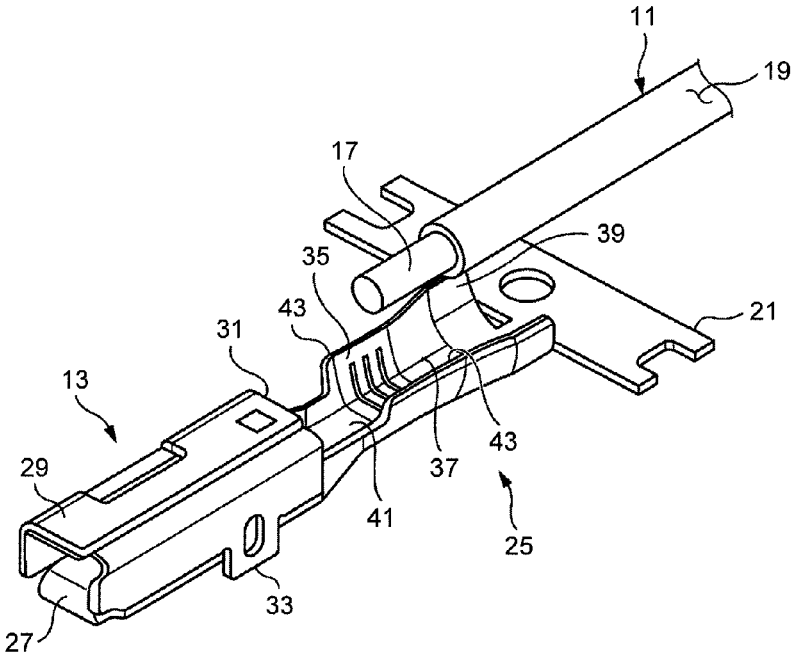
FIG. 3A is an exploded perspective view illustrating the crimp terminal before electric wire crimping.

The conductor crimping portion 35, the joint 37, and the coating crimping portion 39 in the electric wire connector 25 include a common bottom plate 41. The bottom plate 41 includes a right-and-left pair of common swaging pieces 43 that are erected upward from the right and left side edges. As illustrated in FIG. 1, the swaging pieces 43 are folded inside so as to wrap the conductor 17 and the coating 19 of the electric wire 11, and swage the conductor 17 and the coating 19 while the conductor 17 and the coating 19 closely contact the upper surface of the bottom plate 41. As illustrated in FIG. 3A, the electric wire connector 25 is formed to have a U-shaped cross section continuously extending from the front end of the conductor crimping portion 35 to the rear end of the coating crimping portion 39. The electric wire 11 is disposed inside the electric wire connector 25, and is crimped by overlapping a pair of edges on the aperture of the U-shaped structure. Serrations 45 are sawtooth-shaped indents formed on an inner surface of the conductor crimping portion 35. When cutting into the conductor 17, the serrations 45 remove an oxide film formed on the surface of the conductor so as to obtain superior electrical conductivity.

The conductor crimping portion 35, the coating crimping portion 39, and the joint 37 in the electric wire connector 25 are formed continuously from the front end of the conductor crimping portion 35 to the rear end of the coating crimping portion 39. While being crimped to the end part of the electric wire 11, the electric wire connector 25 has a length continuously and integrally covering the range from a front part in front of a front end 47 (see FIG. 1) of the conductor 17 to a rear part behind a coated front end 49 (see FIG. 1).

In this manner, in the crimp terminal 13, the electric wire connector 25 that includes the conductor crimping portion 35 crimping the conductor exposed part where the conductor 17 is exposed by removing the coating 19 of the end part of the electric wire 11, and the coating crimping portion 39 crimping a part of the coating 19 left in the end part of the electric wire 11 from the outer periphery is swaged and crimped to the end part of the electric wire 11.

This crimp terminal 13 is made of a metal material different from the conductor 17 made of aluminum (Al) or an aluminum alloy. In the embodiment, the crimp terminal 13 is made of copper (Cu) or a copper alloy. Tin (Sn) plating is applied to a whole terminal component before press forming. In other words, an identical tin-plated layer 51 (see FIG. 4) is formed on the entire surface. This tin plating processing is applied to the conventional terminal component in the same manner.

The intermediate potential film 15 according to the embodiment is deposited by spraying a metal having a potential different from that of the crimp terminal 13 on the outer periphery of the electric wire connector 25 being crimped to the end part of the electric wire 11 to cover the whole electric wire connector 25. The front end 47 of the conductor 17 exposed inside of the conductor crimping portion 35 is also covered with the intermediate potential film 15. The metal having a potential different from that of the crimp terminal 13 is a metal having a small galvanic current (having a small potential difference) at the time of contacting copper (crimp terminal 13) as compared with aluminum (conductor 17). Examples of the metal include tin (Sn), zinc (Zn), and titanium (Ti).

In the embodiment, zinc (Zn) is used as a metal of the intermediate potential film 15. The spraying of zinc can be performed by, for example, thermal spraying. The thermal spraying is a surface treatment method for forming (depositing) a film on a surface of a base material by spraying particles that are in a melting state or in a state close to the melting due to heating on the surface. The thermal spraying is performed in the atmosphere, differently from the processing performed in a vacuum vessel such as vacuum deposition, sputtering, and ion plating. The intermediate potential film 15 in the embodiment is deposited using this thermal spraying by spraying a molten metal with gas or arc (electric arc) on the electric wire connector 25 with high-pressure gas or high-pressure air. As the metal to be used, various kinds of metals such as chromium, aluminum, and copper other than zinc can be used depending on the purpose. The intermediate potential film 15 formed by the thermal spraying penetrates the surface of the electric wire connector 25, so as to obtain adhesion property. In contrast to the wet plating, the intermediate potential film 15 can be subjected to partial processing. Depositing the intermediate potential film 15 requires a short processing time and no need for drying because of a dry process. The film thickness of the intermediate potential film 15 is approximately from 0.1 mm to 10 mm, and both thin film and thick film are available.

More specifically, the thermal spraying is a process that the powder of metal, alloy, carbide, nitride, oxide, or other materials is injected from nozzles at high pressure, the powder is put in a melting state in flame or plasma to adhere to the surface of a base material, and the thermal spraying produces no deformation on the base material due to a thermal effect. The thermal spraying is roughly classified into gas thermal spraying and electric thermal spraying. The gas thermal spraying is classified into flame thermal spraying and high-speed flame thermal spraying. The flame thermal spraying is further classified into wire thermal spraying, welding electrode thermal spraying, and powder thermal spraying. The electric thermal spraying is classified into arc thermal spraying and plasma thermal spraying. The plasma thermal spraying is classified into air plasma thermal spraying and reduced pressure plasma thermal spraying. The intermediate potential film 15 according to the embodiment may be deposited using any one of the thermal spraying methods as described above.

The following describes a procedure of connecting the crimp terminal 13 to the electric wire 11 according to the embodiment. As illustrated in FIG. 3A, the electric wire 11 is disposed on the inner surface of the electric wire connector 25 formed to have a U-shaped cross section in the crimp terminal 13. The electric wire 11 has the coating-peeled end part (having the coating 19 cut off by a predetermined length) disposed on the upper surface of the bottom plate 41 of the electric wire connector 25. At the time, the front end 47 of the conductor 17 is disposed on the rear part behind a crimping portion front end (front end) 53. The coated front end 49 of the coating 19 is disposed on the front part in front of a crimping portion rear end (rear end) 55.

Figure 4:
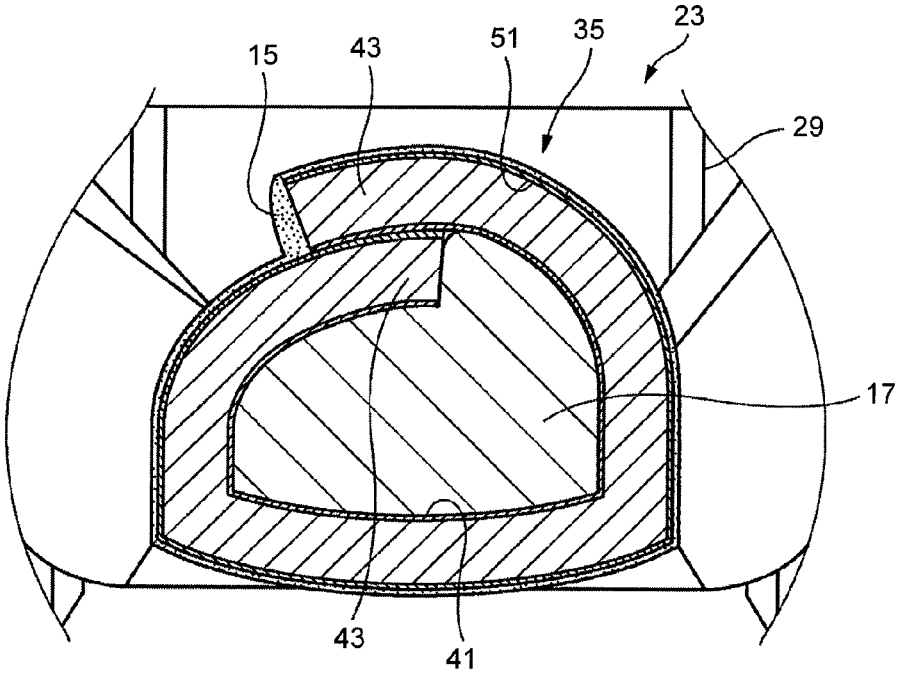
FIG. 4 is a cross-sectional view along line A-A of FIG. 1.

In such a state, a swaging die (not illustrated) is used for crimping the electric wire connector 25 to the end part of the electric wire 11. In other words, the right and left swaging pieces 43 are folded inside in order and swaged so as to wrap the end part of the electric wire 11. The tip end part of the one swaging piece 43 overlaps the tip end part of the other swaging piece 43 as illustrated in FIG. 4.

Figure 3B:
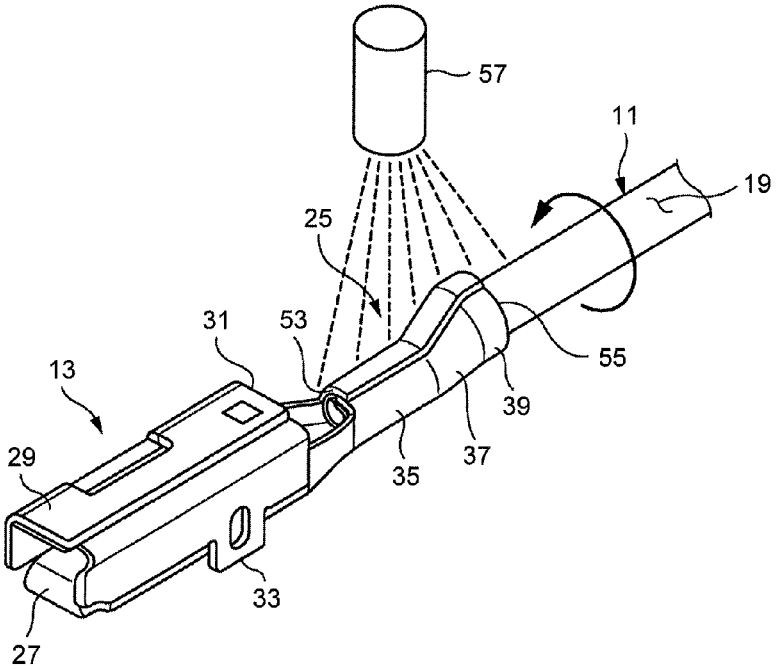
FIG. 3B is a perspective view illustrating a state where zinc is sprayed after electric wire crimping.

Performing swaging in this manner causes the conductor crimping portion 35 of the crimp terminal 13 and the conductor 17 of the electric wire 11 to be electrically connected to each other. Next, zinc is sprayed on the outer periphery of the electric wire connector 25 by the thermal spraying as illustrated in FIG. 3B. In this processing, the crimp terminal 13 may rotate around the axis line of the electric wire 11 with respect to a fixed thermal spraying nozzle 57 (see an arrow direction in FIG. 3B). By contrast, the crimp terminal 13 may be fixed and the thermal spraying nozzle 57 may rotate. In this manner, the intermediate potential film 15 is deposited so as to cover the whole electric wire connector 25 from the outside. A front side (see FIG. 1) of a connection part between the conductor crimping portion 35 and the conductor 17 is covered with the intermediate potential film 15. In other words, in the electric wire connector 25, the range from the crimping portion front end 53 to the crimping portion rear end 55 is covered with the intermediate potential film 15 so as to complete the connecting structure of the crimp terminal 13 and the electric wire 11 according to the embodiment.

The following describes a function of the connecting structure of the crimp terminal 13 and the electric wire 11 having the above-mentioned configuration. In the connecting structure of the crimp terminal 13 and the electric wire 11 according to the embodiment, the intermediate potential film 15 that is made of a metal having a smaller galvanic current (having a smaller potential difference) at the time of contacting the crimp terminal 13 as compared with that of the conductor 17 of the electric wire 11 is sprayed on the electric wire connector 25 of the crimp terminal 13 after electric wire crimping so as to be deposited. In this case, the front end 47 of the conductor 17 that is easily exposed to the outside is also covered with the intermediate potential film 15.

Figure 5:
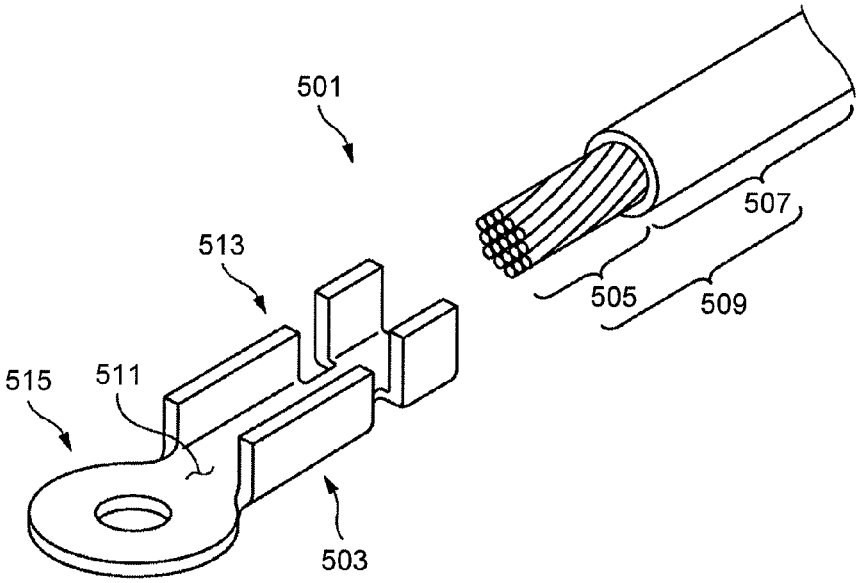
FIG. 5 is an exploded perspective view illustrating a conventional electric wire with a terminal that includes a conductive anticorrosion layer by two kinds of plating processing.

Water splashing in the electric wire connector 25 of the crimp terminal 13 adheres to the intermediate potential film 15 of the outermost layer. Because the front end 47 of the conductor 17 is also covered with the intermediate potential film 15, a boundary between the front end 47 of the conductor 17 and the electric wire connector 25 is also shielded from water by the intermediate potential film 15. In addition, because a gap in the crimped electric wire connector 25 is also covered with the intermediate potential film 15, water is also prevented from intruding the inside of the electric wire connector 25. As compared with the conventional structure where a conductive anticorrosion layer is separately formed on a electric wire contact portion of a crimp terminal (see FIG. 5), a gap is effectively blocked by covering the whole electric wire connector 25. In this manner, the connecting structure of the crimp terminal 13 and the electric wire 11 prevents the crimp terminal 13 and the conductor 17 from being connected to (contacting) each other through water. Resultingly, the connecting structure of the crimp terminal 13 and the electric wire 11 prevents galvanic corrosion due to contact between the crimp terminal 13 and the conductor 17 that are dissimilar metals through water. The right and left swaging pieces 43 are folded inside in order and swaged so as to wrap the end part of the electric wire 11. The tip end part of the one swaging piece 43 overlaps the tip end part of the other swaging piece 43. In this case, even when a gap is created in the overlapping part, the gap is blocked by the intermediate potential film 15 deposited by the thermal spraying. When a gap is large, an area from the gap to an inner space is filled with a metal of the intermediate potential film 15 by the thermal spraying (see FIG. 4). In this manner, the connecting structure of the crimp terminal 13 and the electric wire 11 prevents galvanic corrosion due to contact between the conductor 17 and the crimp terminal 13 that are dissimilar metals contacting each other inside the conductor crimping portion 35 through water in a reliable manner.

When the electric wire connector 25 has contacted water over a long period of time, corrosion starts between the intermediate potential film 15 and the crimp terminal 13. In the connecting structure of the crimp terminal 13 and the electric wire 11, the intermediate potential film 15 (made of a metal having a potential different from that of the crimp terminal 13) that covers the outer periphery of the electric wire connector 25 is corroded first so as to reduce and delay galvanic corrosion of the conductor 17 and the crimp terminal 13 that are made of metals baser than that of the intermediate potential film 15. Resultingly, the connecting structure of the crimp terminal 13 and the electric wire 11 can prevent reduction in the electrical conductivity of the crimp terminal 13 and the electric wire 11, thereby maintaining electric connection performance over a long period of time.

In the connecting structure of the crimp terminal 13 and the electric wire 11, because the intermediate potential film 15 is formed by spraying a metal, the conventional crimp terminal is applicable. Thus, the connecting structure of the crimp terminal 13 and the electric wire 11 avoids management costs caused by an increase in the number of parts. Furthermore, the connecting structure of the crimp terminal 13 and the electric wire 11 can avoid an increase in part cost caused by complicated plating processing using masking.

In the connecting structure of the crimp terminal 13 and the electric wire 11, the conductor 17 is made of aluminum or an aluminum alloy, the crimp terminal 13 is made of copper or a copper alloy, and examples of the intermediate potential film 15 include zinc, which is a metal smaller than a potential difference between copper and aluminum. In the connecting structure of the crimp terminal 13 and the electric wire 11, the intermediate potential film 15 deposited by spraying zinc covers the exposed part of the conductor 17 so as to prevent the connection (contact) between copper and aluminum through water. In the connecting structure of the crimp terminal 13 and the electric wire 11, zinc deposited on the outer periphery of the electric wire connector 25 is corroded first so as to reduce and delay galvanic corrosion of the aluminum-made conductor 17 of the electric wire 11 and the copper-made crimp terminal 13. Resultingly, the connecting structure of the crimp terminal 13 and the electric wire 11 can prevent reduction in the electrical conductivity of the crimp terminal 13 and the electric wire 11, thereby maintaining electric connection performance over a long period of time.

Thus, the connecting structure of the crimp terminal 13 and the electric wire 11 according to the embodiment can delay corrosion of the conductor 17 when the crimp terminal 13 and the conductor 17 made of dissimilar metal materials are connected to each other without applying complicated plating processing, and also prevent corrosion due to intrusion of water.

A connecting structure of a crimp terminal and an electric wire according to the present invention can delay corrosion of a conductor when a crimp terminal and the conductor made of dissimilar metal materials are connected to each other without applying complicated plating processing, and also prevent corrosion due to intrusion of water.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connecting structure of a crimp terminal and an electric wire, the connecting structure comprising:

an electric wire that includes a conductor, an insulating coating covering the conductor, and a conductor exposed part where the conductor is exposed by removing the coating on an end part of the electric wire;

a crimp terminal that is made of a metal material different from that of the conductor and includes an electric wire connector, the electric wire connector including a conductor crimping portion being configured to crimp the conductor exposed part of the end part of the electric wire and a coating crimping portion being configured to crimp a part of the coating left in the end part of the electric wire; and an intermediate potential film that is deposited by spraying a metal having a potential different from a potential of the metal material of the crimp terminal on an outer periphery of the electric wire connector that is being crimped to the end part of the electric wire;

wherein the intermediate potential film includes the metal having the potential different from the potential of the metal material of the crimp terminal.

2. The connecting structure of the crimp terminal and the electric wire according to claim 1, wherein the conductor is made of aluminum or an aluminum alloy, and the crimp terminal is made of copper or a copper alloy.

3. The connecting structure of the crimp terminal and the electric wire according to claim 1, wherein the intermediate potential film is made of zinc.

4. The connecting structure of the crimp terminal and the electric wire according to claim 2, wherein the intermediate potential film is made of zinc.

5. The connecting structure of the crimp terminal and the electric wire according to claim 1, wherein in the crimp terminal, the electric wire connector is formed to have a U-shaped cross section continuously extending from a front end of the conductor crimping portion to a rear end of the coating crimping portion.

6. The connecting structure of the crimp terminal and the electric wire according to claim 2, wherein in the crimp terminal, the electric wire connector is formed to have a U-shaped cross section continuously extending from a front end of the conductor crimping portion to a rear end of the coating crimping portion.

7. The connecting structure of the crimp terminal and the electric wire according to claim 3, wherein in the crimp terminal, the electric wire connector is formed to have a U-shaped cross section continuously extending from a front end of the conductor crimping portion to a rear end of the coating crimping portion.

8. The connecting structure of the crimp terminal and the electric wire according to claim 1, wherein the intermediate potential film is deposited so as to cover the whole electric wire connector that is being crimped to the end part of the electric wire, from an outside of the electric wire connector.

* * * * *